US005083778A

United States Patent [19]

Douglass

[11] Patent Number: 5,083,778

[45] Date of Patent: Jan. 28, 1992

[54] GOLF CLUB PUTTER HEAD

[76] Inventor: Michael B. Douglass, 4999 Iris St., Wheatridge, Colo. 80033

[21] Appl. No.: 544,753

[22] Filed: Jun. 27, 1990

Related U.S. Application Data

[63] Continuation-in-part of Ser. No. 157,373, Feb. 18, 1988, abandoned.

[51] Int. Cl.[5] ..... A63B 53/04

[52] U.S. Cl. ..... 273/78; 273/173; 273/DIG. 10

[58] Field of Search ..... 273/167-175, 273/77 R, DIG. 3, DIG. 6, DIG. 4, DIG. 12, DIG. 22, DIG. 29, 186 D, DIG. 10

[56] References Cited

U.S. PATENT DOCUMENTS

| | | | |
|---|---|---|---|
| 723,358 | 3/1903 | Felton | 273/78 |
| 838,284 | 12/1906 | Thompson et al. | 273/78 |
| 1,562,956 | 11/1925 | Guerne | 273/173 |
| 1,571,109 | 1/1926 | East | 273/173 |
| 1,768,792 | 7/1930 | Schavoir | 273/78 |
| 2,034,936 | 3/1936 | Barnhart | 273/173 |
| 2,660,436 | 11/1953 | Grossman | 273/186 D |
| 2,846,228 | 8/1958 | Reach | 273/169 |
| 3,211,455 | 10/1965 | Hyden | 273/78 |
| 3,218,072 | 11/1965 | Burr | 273/78 |
| 3,937,474 | 2/1976 | Jepson et al. | 273/173 |
| 3,975,023 | 8/1976 | Inamori | 273/173 |
| 4,156,526 | 5/1979 | Huggins et al. | 273/78 |
| 4,199,144 | 4/1980 | Skelly | 273/164 |
| 4,204,684 | 5/1980 | Molitor | 273/167 R |
| 4,422,638 | 12/1983 | Tucker | 273/78 |
| 4,591,160 | 5/1986 | Piragino | 273/167 R |
| 4,679,792 | 7/1987 | Straza et al. | 273/78 |
| 4,804,188 | 2/1989 | McKee et al. | 273/167 R |

FOREIGN PATENT DOCUMENTS

| | | | |
|---|---|---|---|
| 6060576 | 3/1987 | Japan | 273/169 |
| 23691 | of 1907 | United Kingdom | 273/78 |
| 20961 | of 1908 | United Kingdom | 273/78 |
| 2003 | of 1914 | United Kingdom | 273/78 |
| 1405194 | 9/1975 | United Kingdom | 273/186 D |
| 2124910 | 2/1984 | United Kingdom | 273/167 J |
| 2173407 | 10/1986 | United Kingdom | 273/173 |

*Primary Examiner*—William H. Grieb
*Assistant Examiner*—Sebastiano Passaniti
*Attorney, Agent, or Firm*—Richard W. Hanes

[57] ABSTRACT

A golf putter having a novel putter head is disclosed. The putter head includes a body of generally rigid material and a resilient laminated striking face which is secured to a club face undersurface defined by the putter head body. The laminated striking face includes at least an outer layer of resilient material having an outer surface for striking a golf ball and an inner layer of resilient material which is secured against the club face undersurface and which has a hardness which is less than that of the outer layer. The resilient outer layer preferably has a hardness which is equal to or greater than the hardness of a golf ball which is generally greater than about 90 durometers A.

1 Claim, 3 Drawing Sheets

GOLF CLUB PUTTER HEAD

This is a continuation-in-part of application Ser. No. 07/157,373 filed 2/18/88, to the same inventor, now abandoned.

BACKGROUND OF THE INVENTION

This invention relates to golf clubs and more particularly to the putter head of a putter type club.

A golfer's desire for a putter providing improved putting accuracy and control is well documented by the number of patents directed to putter type clubs. Some of the more recently issued patents in this area disclose putters having striking faces which are made from a different, generally more resilient, material than the body of the putter head itself which is typically made from a metal such as brass, steel or aluminum or some other relatively rigid material such as a graphite or ceramic composite.

One of the earliest known putters having a striking face made from a resilient material is disclosed in U.S. Pat. No. 3,211,455 to Hyden. The resilient material in Hyden is preferably a rubber having a hardness between about 65 and 85 durometers. The resilient striking face is stated to provide the golfer with a greater sense of touch or feel during stroking of the ball, especially on a putting green.

U.S. Pat. No. 3,218,072 to Burr discloses golf club heads utilizing prestressed porous carbon inserts to form the striking faces. Porous carbon's resiliency is stated to make it possible to increase the rebound of a golf ball from the striking face of the club when the ball is struck with the club, thereby increasing the distance that the golf ball can be driven. The compressibility and elasticity of porous carbon is also disclosed as making it possible to firmly secure the insert in the club head without having to use adhesives, screws or other attaching means.

U.S. Pat. No. 4,156,526 to Huggins et al. discloses a putter having a putter head which defines an elongate cavity in which a resilient block is disposed which serves as the putter striking face. The size and shape of the block is such that when striking a golf ball, the rearwardly deformed area of the block assumes an elliptical shape which moves in vertical direction relative to the golf ball when the deformed area returns to its initial configuration. This vertical movement of the block is disclosed as having no tendency to divert the golf ball from a path normal to the putter striking surface. As such, putting accuracy is apparently maintained.

U.S. Pat. No. 4,199,144 to Skelly discloses a putter having a striking face made of rock hard plastic. The rock hard plastic is said to deliver a stronger force against the golf ball than the putter face of a conventional putter so that the ball will travel approximately 4 to 8 inches farther than conventionally expected.

U.S. Pat. No. 4,422,638 to Tucker discloses a golf putter having a soft face formed from an elastomer having high resiliency and a hardness greater than about 70 durometer A and preferably less than the hardness of a golf ball which is stated to be in the range of 99 durometer A and 50 durometer D at the surface of the ball. The high resiliency of the elastomer is believed to cause the ball to rebound sharply without energy loss, thereby increasing the distance of ball travel. This, in turn, permits utilization of a shorter back swing which is stated to substantially increase accuracy of the back swing and, thus, the direction of ball travel.

U.S. Pat. No. 4,679,792 to Straza et al., discloses a golf putter head having a striking face insert which comprises a honeycomb cellular structure. The honeycomb cells are filled with a resilient, epoxy material to increase momentum imported to a golf ball upon impact. The exposed edges of the honeycomb cells which contact the ball on impact are stated to prevent slippage and enhance directional control over the ball line of travel.

The use of ceramics as a face plate for a golf club is well known. Such is shown in U.S. Pat. No. 3,975,023 to Inamori. Such ceramic face plates are designed to be extremely non-yielding (note FIG. 7), and are capable of increasing the flying distance of the ball. Thus, an appreciable dampening effect is not achieved.

Similarly, metal face plates even when backed with higher elasticity material, as shown in Japanese Document No. 2060-576 to Nagasaki et al. are used to obtain "good batting condition." Dampening of the rebound of the struck ball and energy absorbing features are not discussed.

The use of laminated layers for golf clubs is well known as shown by U.S. Pat. No. 4,204,684 to Molitor. Such laminations, however, are arranged generally parallel with the sole or lower surface of the club. The laminated layers do not form only the striking face secured to a golf club body. In fact, the construction of Molitor renders "unnecessary the use of a sole plate or an insert or face piece in the impact face of the head" (column 2), and thus teaches away from such a use.

While there can be no doubt that the aforedescribed putters and clubs have satiated many a golfer, at least psychologically, the thirst of many a golfer for a new and improved putter or club remains unquenched.

SUMMARY OF THE INVENTION

An object of the present invention is to provide a putter which dampens or reduces rebound of the golf ball from the striking face of the putter to increase control over the ball's line of travel and distance of travel, thereby increasing putting accuracy.

Another object of the present invention is to provide a putter having a larger sweet spot which provides the golfer which a greater sense of touch and feel when making a putt, thereby increasing putting accuracy.

Yet another object of the present invention is to provide a putter which decreases surface contact of the golf ball with the striking face of the putter to increase control over the golf ball's line of travel, thereby increasing putting accuracy.

A further object of the present invention is to provide a putter which increases the length of the golfer's backstroke during putting to increase putting accuracy, particularly when making short putts of less than about six feet.

Another object of the instant invention is to provide a putter or golf club which will absorb shear forces generated during deflection of a yielding face plate when a ball is struck. Such a struck ball will then tend to rebound in a direction more perpendicular to the face of the club or putter in a dampened manner.

In accordance with these objectives, the present invention provides a golf club head including a body defining a club face undersurface and a laminated golf ball striking face which is secured to the body against the body's undersurface. The laminated striking face includes at least an outer resilient layer and an inner resilient layer. The other layer defines a surface for striking a golf ball. the inner layer is secured against the body's undersurface and has a hardness which is less than that of the outer layer. A third viscous layer could also be provided between the outer and inner layers.

In a preferred embodiment, the outer layer has a hardness which is equal to or greater than the hardness of a golf ball which is generally at least about 90 durometers A. The inner layer is preferably made from a softer material having a hardness between about 35 and 90 durometers A. The body of the golf club head is preferably made from a relatively rigid material such as a metal, a ceramic composite or a graphite composite. The club face undersurface is preferably recessed in a cavity defined by the club head body and the laminated striking face is preferably in the form of an insert which is mounted in the cavity so that the outer surface of the insert's outer layer is contiguous and flush with an outer front surface defined by the club head body. The cavity and insert also preferably include dove-tail shaped portions which matingly engage each other to mechanically secure the insert in the cavity against the body's undersurface.

The present invention also provides a golf putter including a club shaft having a gripping portion at one end of the shaft and a putter head attached to the other end of the shaft. The putter head includes a body defining a club face undersurface and a laminated striking face which is secured to the putter head's body against the undersurface. The laminated striking face includes at least an outer layer of resilient material having an outer surface for striking a golf ball, an inner layer of resilient material which is secured against the putter head body's undersurface. An intermediate viscous layer could also be provided between said inner and outer layers. The inner layer has a hardness which is less than that of the outer layer.

The present invention also provides a golf ball striking face for a putter head which includes a laminate having at least an outer layer of resilient material for striking the surface of a golf ball and an inner layer of resilient material for attachment to a surface of the putter head. An intermediate viscous layer could also be provided between said inner and outer layers. The inner layer has a hardness which is less than that of the outer layer.

Additional advantages of this invention will become apparent from the description which follows, taken in conjunction with the accompanying drawings.

DESCRIPTION OF THE PREFERRED EMBODIMENT

Figure 1:
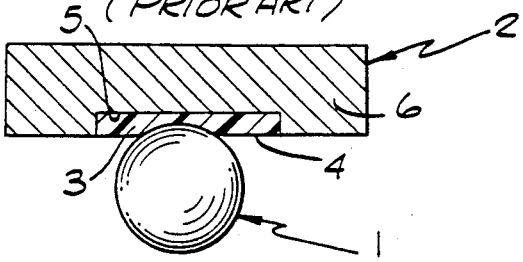
FIG. 1 (PRIOR ART)
FIG. 1 is a top cross-sectional view of a prior art putter head which illustrates the surface contact made between an elastomeric striking face insert of the putter head and a golf ball which is being struck by the putter head.

FIG. 1 illustrates a golf ball 1 being struck by a putter head 2 of a conventional putter (not shown). The putter head has an elastomeric, single layer, striking face insert 3 which defines a golf ball striking surface 4. Insert 3 is mounted in and secured to a cavity 5 defined by a metallic body 6 of the putter head.

As illustrated in FIG. 1, insert 3 undergoes substantial deformation when it makes contact with the golf ball. As such, there is substantial surface contact between striking surface 4 of insert 3 and the surface of the golf ball. Such surface contact is undesirable in that it apparently causes the golf ball to erratically rebound from the striking surface of the insert.

This problem is discussed in U.S. Pat. No. 4,156,526 to Huggins et al. wherein it is disclosed that erratic rebounding (or lateral deflection of the golf ball) can be avoided with an elastomeric striking surface which deforms elliptically when struck. The elliptical deformation is stated to cause the golf ball to rebound in a direction which is normal to the striking surface of the ball. As such, lateral deflection or erratic rebounding of the ball is apparently avoided.

While Huggins provides a solution to erratic rebounding, it is believed that the problem can also be solved or at least greatly minimized by reducing the extent of surface contact between the striking surface of the putter head and the surface of the golf ball. With less surface contact (i.e., more point-like contact), fewer and less powerful laterally directed rebounding forces should contact the golf ball. Accordingly, the golf ball should rebound in a direction normal to the striking surface of the putter head, thereby solving the problem of erratic rebounding.

FIGS. 2 through 6 illustrate a preferred embodiment of a putter head 10 of the present invention which has as an object, among others, the minimization of surface contact between the striking surface of the putter head and the surface of the golf ball.

Figure 2:
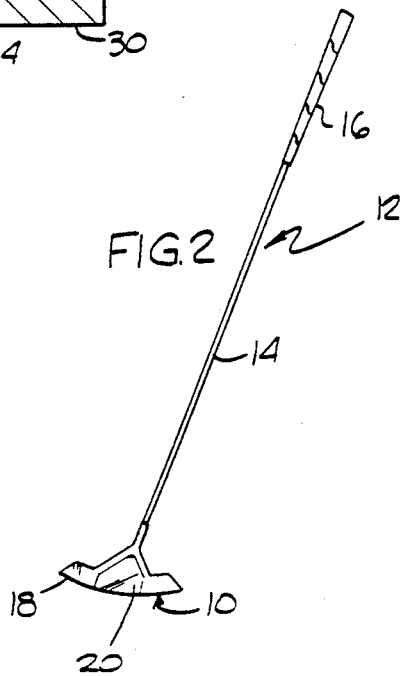
FIG. 2 is a side view of a putter of the present invention.

FIG. 2 illustrates a putter 12 having a shaft 14 with putter head 10 attached to one end of the shaft and a gripping portion 16 attached to the shaft's other end. The putter head and gripping portion 16 are preferably attached to shaft 14 with an adhesive such as glue. Other attaching means known to those skilled in the art may also be employed and such are considered to be within the purview of the present invention.

Figure 3:
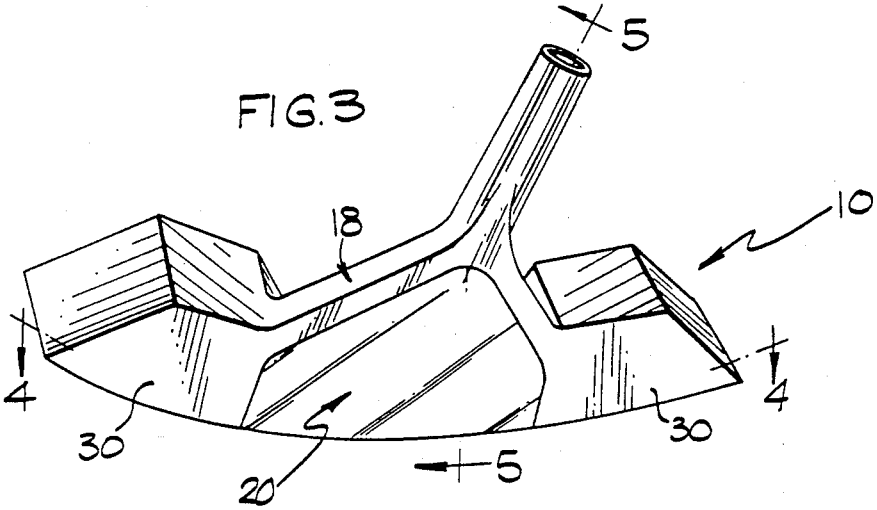
FIG. 3 is a perspective view of a putter head of the present invention.
Figure 4:
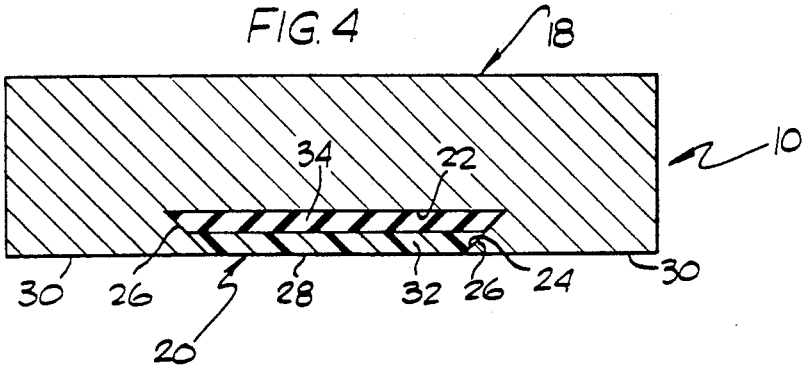
FIG. 4 is a cross-sectional view taken along lines 4—4 of FIG. 3.
Figure 5:
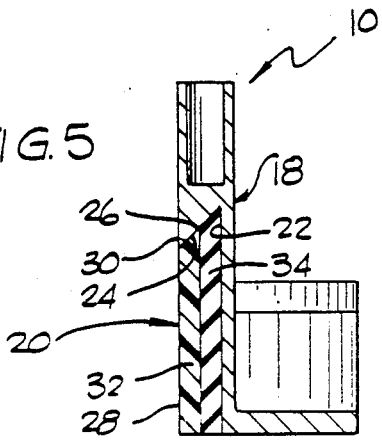
FIG. 5 is a cross-sectional view taken along lines 5—5 of FIG. 3.

As best illustrated in FIGS. 3 through 5, putter head 10 generally includes a body 18 (preferably made of a rigid material such as a metal, a graphite composite or a ceramic composite) and a laminated club striking face insert 20.

Insert 20 is mounted in a cavity (not numbered) of body 18 which is defined by an undersurface 22 and a beveled or dove-tail shaped portion or wall 24. The insert is mechanically secured to the body against undersurface 22 by providing the insert with a beveled or dove-tail shaped edge or portion 26 which matingly engages with dove-tail shaped wall 24. While not illustrated, adhesives and other known attaching means may be employed within the spirit of the present invention to secure the insert to undersurface 22.

Insert 20 is also sized and configured to define a planar striking surface 28 which, as best illustrated in FIGS. 3 through 5, is contiguous, coplanar and flush with a generally planar front body surface 30 defined by body 18.

Laminated insert 20 also includes at least two resilient layers; an outer resilient layer 32 and an inner resilient layer 34. The outer resilient layer in accordance with an important aspect of the present invention has a hardness which is greater than that of inner layer 34. In a preferred embodiment, the outer layer has a hardness greater than that of a conventional golf ball which is about 90 durometers as measured by the Shore A test.

It is also preferred that the outer layer have a hardness which is less than 110 durometers A. A resilient, thermoplastic polymer having a hardness which is suitable for use as outer layer 32 is an ionomer resin made and sold by the Du Pont Company of Wilmington, Del. under the trade name Surlyn 8660. Surlyn 8660 has a hardness of 62 durometers Shore D which is equal to about 98 durometers on the Shore A scale. The Du Pont Company also makes other Surlyn ionomer resins which may be suitable for use as outer layer 32. Surlyn is a registered trademark of the Du Pont Company. The thickness of the outer layer ranges from 0.05 inches to 0.35 inches.

Resilient inner layer 34 having a hardness less than that of the outer layer is preferably made from an elastomeric material such as rubber. Inner layer 34 may also be made from soft Surlyn ionomer resins such as Surlyn 9450 which has a hardness, Shore D, of 54 durometers. The thickness of the inner layer ranges from 0.05 inches to 0.35 inches.

Figure 6:
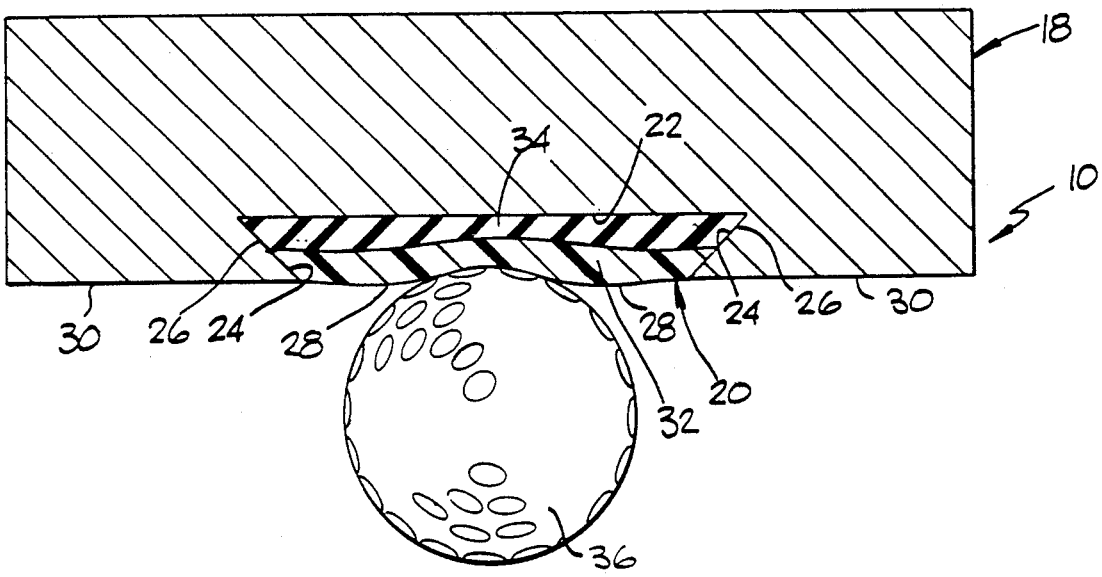
FIG. 6 is a cross-sectional view similar to that illustrated in FIG. 3 showing the deformation which takes place in a laminated striking face insert of the present invention when striking a golf ball.

FIG. 6 illustrates the deformation believed to take place in insert 20 when a golf ball 36 is struck by a golfer utilizing the putter of the present invention. As illustrated, outer layer 32 bends or yields inwardly without compressing to any substantial extent while inner layer 34 distorts significantly. Since outer surface 34 bends or yields inwardly rather than compressing significantly (which is what happens to the single layer insert illustrated in FIG. 1) surface contact between the golf ball and the outer layer striking surface 28 is greatly reduced. This can be easily visualized by comparing the surface contact which takes place between ball 36 and surface 28 in FIG. 6 with the surface contact taking place between golf ball 1 and striking surface 4 of insert 3 illustrated in FIG. 1. As can be seen, there is much less surface contact with the ball in FIG. 6 than there is in FIG. 1. Accordingly, golf balls struck with the putter head of the present invention illustrated in FIG. 6 should experience much less erratic rebounding than those struck with that illustrated in FIG. 1. As such, a golfer's ability to maintain control over the ball's line of travel should be greatly enhanced with the putter of the present invention. Thus, putting accuracy should be greatly improved.

The deformation which takes place in insert 20 as illustrated in FIG. 6 also slightly dampens or reduces rebound of the ball. Such dampening occurs because outer layer 32 bends across almost its entire length which, in turn, distributes the ball's energy of impact over a wider area across inner layer 34. Accordingly, with more surface area available for energy absorption, inner layer 34 is capable of absorbing more energy than an insert consisting of a single layer of material such as that illustrated in FIG. 1 wherein deformation (and thus energy absorption) is more localized.

Figure 7:
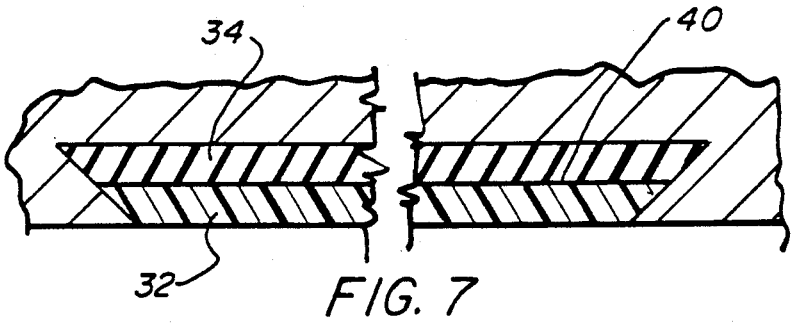
FIG. 7 is a cross-sectional view similar to FIG. 4 showing a laminated striking face having three layers.
Figure 8:
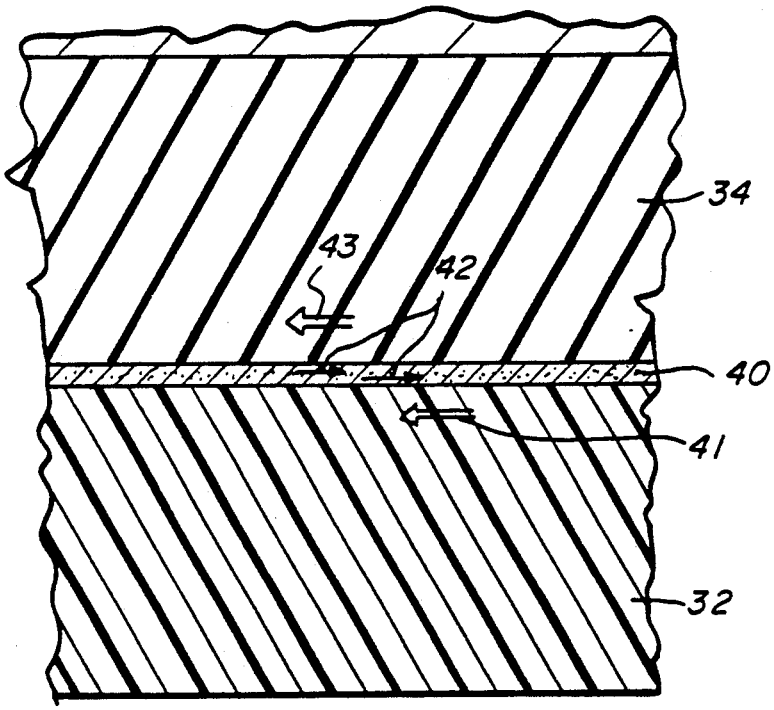
FIG. 8 is an enlarged section of the cross-section of FIG. 7.

A further embodiment of the invention is illustrated in FIGS. 7 and 8. In this embodiment, the two laminated layers 32 and 34 are secured together using a suitable viscous or tacky adhesive 40 also known as transfer adhesive. This forms a very thin third layer in the laminated insert structure.

As illustrated in FIG. 8, the layer 40 is capable of movement relative to layers 34 and 32 and thus is energy absorbing. Assuming the outer layer 32 is struck and moves in a direction indicated by arrow 41, the transfer adhesive 40 applies opposing forces in the direction of the arrows 42. Inner layer 34 responds with movement in the direction of arrow 43. The viscous nature of the adhesive layer 40 allows layers 34 and 32 to move relative to each other. Thus the viscous layer 40 absorbs energy in the relative movements of the layers and such energy is given off as heat. This energy absorption dampens the rebound of the ball. Shear forces will be absorbed by the relative movements of the laminated layers. Thus, the ball will tend to rebound in a direction more perpendicular to the striking face in a dampened manner.

Figure 9:
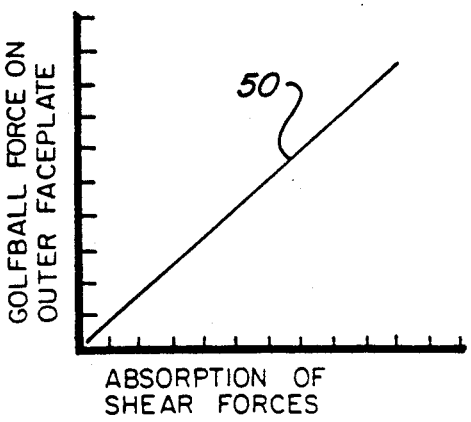
FIG. 9 is a graph showing the relationship between the striking force of a golf ball on a putter and club and the absorption of shear forces in the movement of the face plate.

FIG. 9 shows a graph depicting the relationship of the force of the ball struck on the outer face plate to the absorption of the shear forces. As shown in the graph at 50, the absorption of shear forces increases proportionally to the force of the ball.

Figure 10:
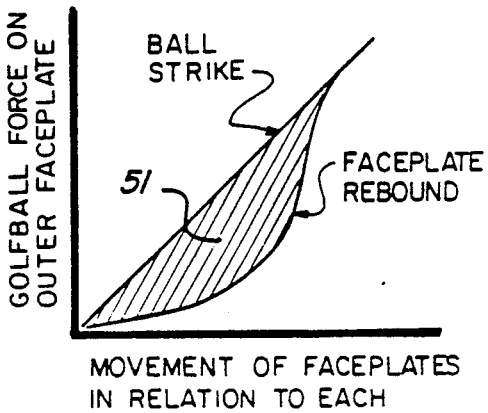
FIG. 10 is a graph showing the energy absorbed by the movement of layers of the laminated face plate of the instant invention.

FIG. 10 shows a graph of the movement of the outer face plate as a function of the force of the ball. The straight line on the graph represents the force of the ball on the face plate and the resulting deflection of the face plate. The curving line shows the return movement of the face plate from its deflected condition and the reduced force applied to the ball during its rebound. The shaded area 51 bounded by these graphs represents the mechanical energy absorbed from shear strain in the viscous transfer adhesive layer 40. The energy absorption feature of the instant invention results in a dampening or reduction in ball rebound. Such dampening (or reduction in ball rebound) also apparently causes the ball to remain on striking surface 28 of the outer layer for a fraction of a second longer than it does when striking a surface having high rebound characteristics such as that illustrated in U.S. Pat. No. 4,422,638 to Tucker. This is advantageous since it gives the golfer the feeling of having a larger sweet spot on the striking surface of the putter head. Dampening also enhances putting accuracy by providing the golfer with the feel of actually "pushing" the ball to the hole.

Dampening of ball rebound also permits utilization of a longer backstroke which, despite claims to the contrary, enhances putting accuracy, particularly when making short putts of less than about six feet. Contrary to popular belief, most short putts are missed, not because the golfer chokes, but rather because the golfer's backstroke is not long enough to enable him to accurately align the striking face of the putter head with the desired line of ball travel. A longer backstroke also makes it easier for the golfer to control the amount of force delivered to the ball when making the putt, thereby enhancing the golfer's ability to control the distance the ball travels.

This invention has been described in detail with reference to a particular embodiment, but it will be understood that various other modifications can be effected within the spirit and scope of this invention.

What is claimed:

1. A golf putter comprising:

a club shaft having a gripping portion at one end of said shaft;

a putter head attached to the other end of said shaft, said putter head including a body defining a club face undersurface and a yieldable laminated striking face secured to said body against said undersurface, said laminated striking face comprising an outer resilient layer, an inner resilient layer, and an intermediate layer between said inner and outer layers, said laminated striking face being yieldable to absorb energy when struck by a ball so as to achieve controlled dampening of the struck ball, said intermediate layer being viscous to enable said inner and said outer resilient layers to move laterally relative to one another when said outer resilient layer is struck, whereby the viscous layer absorbs shear forces associated with said struck ball.

* * * * *